US006145676A

United States Patent [19]

Gross

[11] Patent Number: 6,145,676

[45] Date of Patent: Nov. 14, 2000

[54] MAGNETIC STORAGE RACK

[76] Inventor: Anthony Gross, 8811 S. Stillhouse Rd., Oak Grove, Mo. 64075

[21] Appl. No.: 09/391,438

[22] Filed: Sep. 8, 1999

[51] Int. Cl.[7] ..... A47F 5/08

[52] U.S. Cl. ..... 211/87.01; 211/70.6

[58] Field of Search ..... 211/70.6, DIG. 1, 211/87.01; 248/309.4, 206.5

[56] References Cited

U.S. PATENT DOCUMENTS 2,733,113 1/1956 Humbargar .
3,363,775 1/1968 Shaw .
3,776,387 12/1973 Brent .
4,826,059 5/1989 Bosch et al. .
5,760,668 6/1998 Testa et al. .

*Primary Examiner*—Alvin Chin-Shue
*Assistant Examiner*—Sarah Purol
*Attorney, Agent, or Firm*—Goldstein & Canino

[57] ABSTRACT

A magnetic storage rack for storing a plurality of objects therein including metallic parts. The magnetic storage rack comprising a sheet magnet having an exposed surface, and a plurality of slab magnets adhered to the exposed surface of the sheet magnet. The slab magnets are arranged in rows of two or more slab magnets each, wherein metallic parts and tools may be adhered to the slab magnets for effective storage and organization thereof.

5 Claims, 3 Drawing Sheets

MAGNETIC STORAGE RACK

FIELD OF THE INVENTION

The invention relates to a storage rack. More particularly, the invention relates to a storage rack kit that is constructed from a plurality of magnetic pieces to allow securement of metallic tools and parts thereto.

BACKGROUND OF THE INVENTION

Everyone is familiar with the need for storage of their belongings in their homes. As a result, almost every home generally has storage units, such as closets, cupboards, storage racks, etc. to enable the occupants to store and neatly organize their possessions. Not only are storage units widely used in people's households but also in businesses which require merchandise to be exhibited for selection by the customers.

Storage units are also widely used by businesses that perform repairs or businesses that utilize raw materials to produce finished goods. For example, it is very common to see storage units in car repair centers, wherein the storage units are used for neatly organizing nuts, bolts, car parts, tools or the like. These storage units are generally constructed from wood or metal, which is disadvantageous in that it fails to secure metallic parts therein; consequently, the stored parts often slip out, and, in the case of small components, these parts are often lost.

In addition, it is difficult to store commonly used small metallic components in a way in which they are also easily seen and easily retrieved. Most storage solutions for small components place them in the corner of a small drawer, where they are difficult to find when needed.

Similarly, few effective storage solutions have been proposed for magnetic tools which allow them to be stored out of the way, yet still be instantly available when needed.

To overcome the disadvantages of the typical wood or metallic storage units, some have suggested the use of magnetic storage units. Examples of such storage units are disclosed in U.S. Pat. No. 4,303,158 to Perkins, U.S. Pat. No. 5,405,004 to Vest et al. and U.S. Pat. No. 5,699,910 to Kubat.

While the prior art units may be suitable for the particular purpose employed, or for general use, they would not be as suitable for the purposes of the present invention as disclosed hereinafter.

SUMMARY OF THE INVENTION

It is an object of the present invention to provide a storage unit.

It is another object of the present invention to provide a storage unit that can securely hold and allow neat storage of a plurality of metallic parts therein. Accordingly, the present invention discloses a magnetic storage rack that comprises a sheet magnet and a plurality of ceramic magnets. The sheet magnet is a generally weak magnet with a large surface area which allows attachment directly to a metallic surface. The ceramic magnets are strong magnets adhered onto the sheet magnet such that they extend parallel to the sheet magnet. Thus, the ceramic magnets form a plurality of slabs with strong magnetic attractive properties which allows the user to store various different objects thereon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims and their legal equivalents.

BRIEF DESCRIPTION OF THE DRAWINGS

The above and other aspects, features and advantages of the present invention will be more apparent from the following detailed description thereof, which is presented in conjunction with the following drawings, wherein corresponding reference characters indicate corresponding components throughout the drawing figures.

DETAILED DESCRIPTION OF THE PREFERRED EMBODIMENTS

Figure 1:
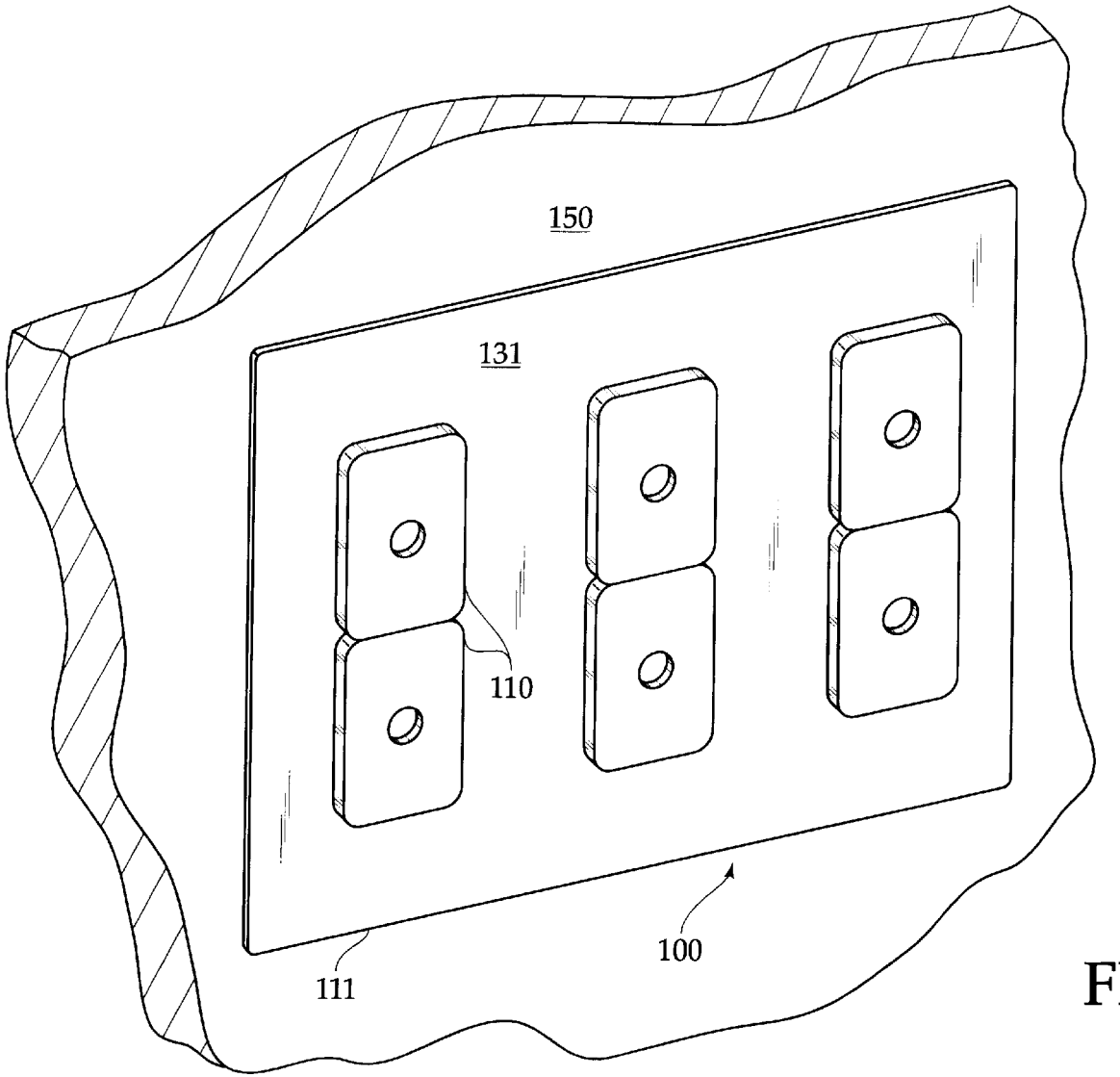
FIG. 1 is a diagrammatic perspective view of the magnetic storage rack constructed in accordance with the present invention.
Figure 2:
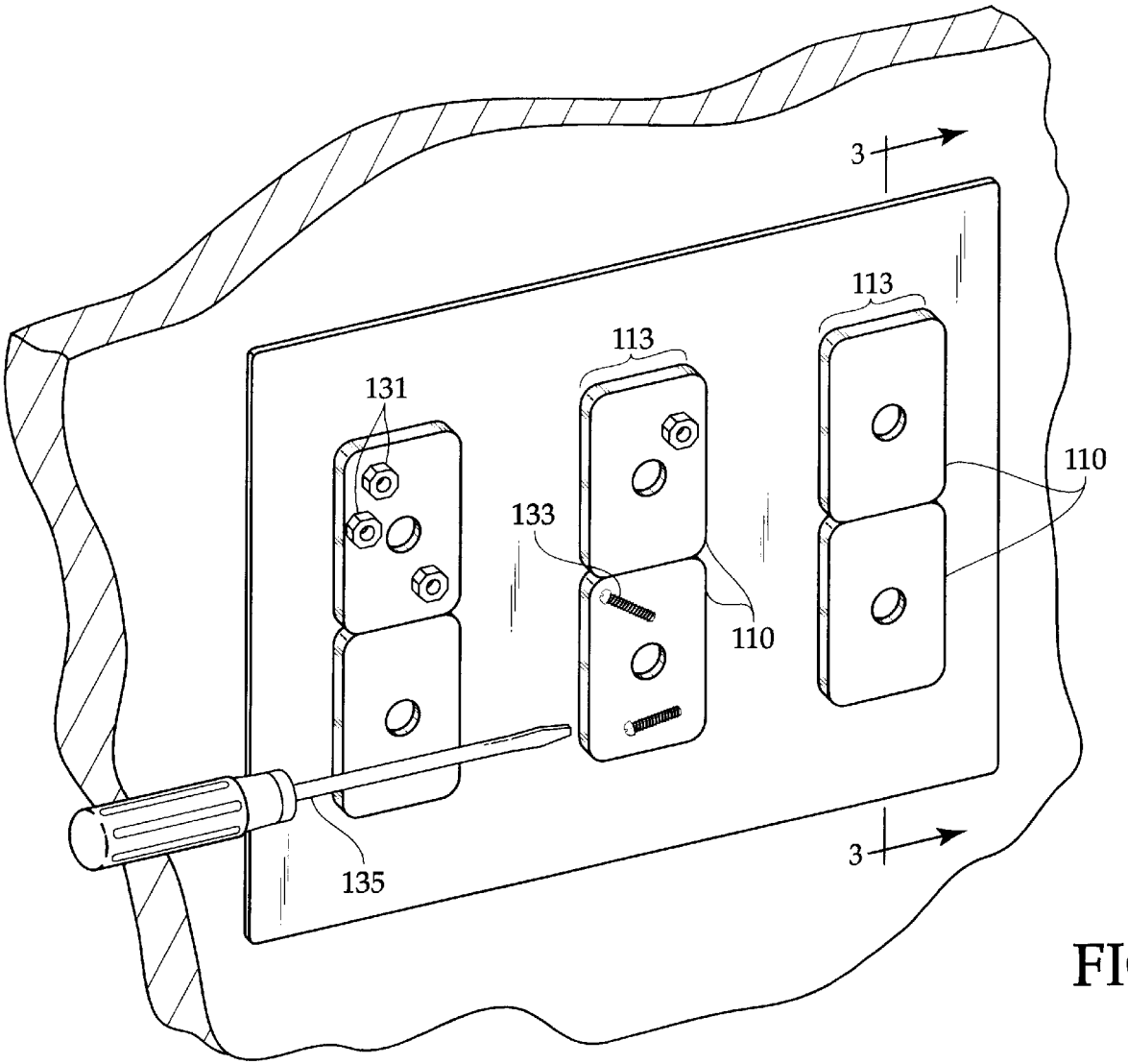
FIG. 2 is a diagrammatic perspective view of the magnetic storage rack in use.
Figure 3:
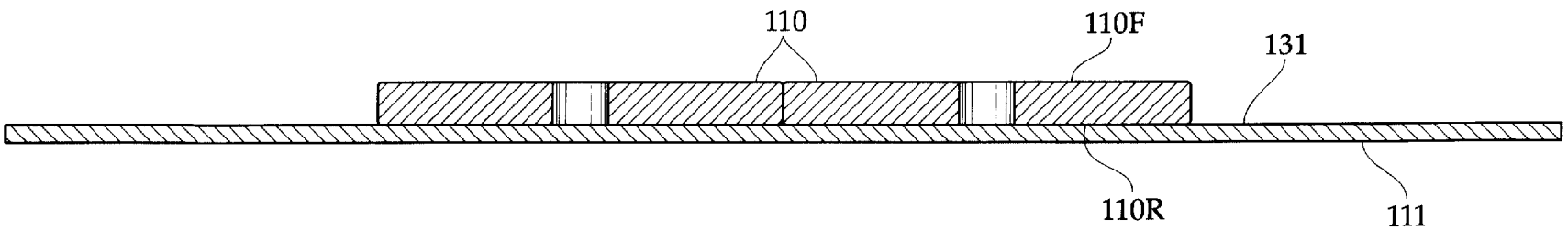
FIG. 3 provides a sectional view of the storage rack taken along arrow 3—3 in FIG. 2.

FIGS. 1–3 disclose a magnetic storage rack 100. As shown in FIG. 2, the magnetic storage rack 100 will be used to store a variety of objects, including metallic objects such as nuts 131, bolts 133, tools 135 or other small parts. According to the invention, the magnetic force of the magnetic storage rack 100 causes the metallic parts to be secured thereto.

As shown in FIG. 1, the magnetic storage rack 100 comprises a sheet magnet 111, which has an exposed surface 131. The sheet magnet 111 is provided as a substantially thin and flat board, approximately one sixty-fourth of an inch in thickness, that is capable of laying flush against a metallic surface 150.

The magnetic storage rack 100 comprises a plurality of slab magnets 110 which each have a front surface 110F and a rear surface 110R. The rear surface 110R of each slab magnet 110 is adhered to the exposed surface 131 of the sheet magnet 111.

The sheet magnet 111 is a fairly weak magnet, such that it is generally incapable of providing a sufficient localized magnetic force to support even a nut, bolt or screw. However, because of its large surface area, the sheet magnet 111 can generate a sufficient global force to adhere to a metallic surface such that it can support the weight of the magnetic storage rack 100, and items stored thereupon.

The slab magnets 110 are generally ceramic magnets which have a large localized force, and thus not only capable of adhering to the sheet magnet 111, but are also capable of directly supporting small metallic objects. The slab magnets are robust constructions—typically three quarters of an inch in width, one inch in height, and an eight of an inch in thickness. Referring to FIG. 2, a plurality of metallic objects have been adhered to the slab magnets 110. More particularly nuts 131, bolts 133, and even a screwdriver tool 135 has been adhered to the slab magnets 110.

The slab magnets 110 are arranged in rows 113 on the sheet magnet 111. Each row 113 may comprise two or more slab magnets 110. Advantageously, the rows 113 may be spaced so as to accommodate tools 135 therebetween. As seen in FIG. 2, a tool can be easily extended across two rows 113, so that it is held in place thereat. Accordingly, the slab magnets 110 can be rearranged according to the user's preferences and storage needs.

As is evident, the present invention allows construction and reconfiguration of the magnetic storage rack 100 in a number of shapes, sizes and configurations.

In summary, herein is disclosed a magnetic storage rack for storing a plurality of objects therein including metallic parts. The magnetic storage rack comprising a sheet magnet having an exposed surface, and a plurality of slab magnets adhered to the exposed surface of the sheet magnet. The slab magnets are arranged in rows of two or more slab magnets each, wherein metallic parts and tools may be adhered to the slab magnets for effective storage and organization thereof.

Many specific details contained in the above description merely illustrate some preferred embodiments and should not be construed as a limitation on the scope of the invention. Accordingly, many other variations are possible within the spirit of the present invention, limited only by the scope of the appended claims and their legal equivalents.

Having described my invention, I claim:

1. A magnetic storage rack for storing a plurality of objects therein including metallic parts on a vertical metallic surface, the storage rack comprising:

a sheet magnet having an exposed surface, the sheet magnet adhering to the vertical metallic surface;

a plurality of slab magnets, the slab magnets are at least several times thicker than the sheet magnet and are at least several times more powerful than the sheet magnet, each of the slab magnets having a front and a rear, the rear of each slab magnet is adhered to the sheet magnet.

2. The magnetic storage rack of claim 1, wherein the slab magnets are ceramic magnets arranged in rows on the sheet magnet.

3. The magnetic storage rack of claim 2, wherein the rows each comprise two or more slab magnets.

4. The magnetic storage rack of claim 2, wherein each slab magnet is approximately three quarter inches wide, one inch high, and one eight inch thick.

5. The magnetic storage rack of claim 4, wherein the sheet magnet is substantially one sixty fourth of an inch thick.

* * * * *